US011318527B2

(12) United States Patent
Troyer et al.

(10) Patent No.: US 11,318,527 B2
(45) Date of Patent: May 3, 2022

(54) MANUFACTURING METHOD FOR FINISHING OF CERAMIC CORES FLASH

(71) Applicant: Siemens Aktiengesellschaft, Munich (DE)

(72) Inventors: Timothy Troyer, Charlottesville, VA (US); Gabriela Garcia-Antunez, Charlottesville, VA (US); Robert Bruce, Barboursville, VA (US); Andrew Belling, Charlottesville, VA (US); Lara Richerson, Charlottesville, VA (US); Douglas Bibb, Staunton, VA (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/972,632

(22) PCT Filed: Jun. 19, 2018

(86) PCT No.: PCT/US2018/038260

§ 371 (c)(1),
(2) Date: Dec. 7, 2020

(87) PCT Pub. No.: WO2019/245532

PCT Pub. Date: Dec. 26, 2019

(65) Prior Publication Data

US 2021/0237146 A1 Aug. 5, 2021

(51) Int. Cl.

| | |
|---|---|
| ***B22C 9/18*** | (2006.01) |
| ***B22C 9/10*** | (2006.01) |
| ***F01D 5/18*** | (2006.01) |

(52) U.S. Cl.

CPC ..... *B22C 9/10* (2013.01); *B22C 9/18* (2013.01); *F01D 5/187* (2013.01); *F05D 2230/211* (2013.01)

(58) Field of Classification Search

CPC ..... B22C 9/10; B22C 9/18; F05D 2230/211

See application file for complete search history.

(56) References Cited

U.S. PATENT DOCUMENTS

| | | | | |
|---|---|---|---|---|
| 5,465,780 | A | 11/1995 | Muntner et al. | |
| 6,847,004 | B2 * | 1/2005 | Das | B23K 26/0622 219/121.71 |

(Continued)

FOREIGN PATENT DOCUMENTS

| | | | |
|---|---|---|---|
| EP | 1437194 | A2 | 7/2004 |
| FR | 2929164 | A1 | 10/2009 |
| WO | 2015051916 | A1 | 4/2015 |

OTHER PUBLICATIONS

PCT International Search Report and Written Opinion of International Searching Authority dated Apr. 18, 2019 corresponding to PCT International Application No. PCT/US2018/038260 filed Jun. 19, 2018.

*Primary Examiner* — Nirvana Deonauth

(57) ABSTRACT

A method of manufacturing for finishing ceramic core flash. Locating a first hole on a ceramic core by a laser sensor on a robot. Probing for a center of the first hole by a force-torque sensor on the robot. Scanning for an axial position of a second hole on the ceramic core. Scanning for a third hole on the ceramic core. Probing for a center of the third hole. Determining axial and radial scale factors based on the first hole location and the third hole location. Uploading the axial and radial scale factors to the robot Multiplying the X component position by the axial scale factor and the Z component position by the radial scale factor in an array format. Cutting a designated scaled location along the ceramic core to remove flash. Repeating process for additional scaled locations along the ceramic core.

4 Claims, 5 Drawing Sheets

(56) References Cited

U.S. PATENT DOCUMENTS

2019/0368357 A1* 12/2019 Eshak ..... F01D 5/18
2021/0146456 A1* 5/2021 Clossen-von Lanken Schulz .....
F01D 5/005

* cited by examiner

MANUFACTURING METHOD FOR FINISHING OF CERAMIC CORES FLASH

BACKGROUND

1. Field

The present invention relates to manufacturing advanced ceramic cores and the tooling for the manufacturing finishing of ceramic cores.

2. Description of the Related Art

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, and the slots engaging these blades must be made from components that can handle the high engine firing temperatures. These components can also be cooled through the process to increase potential life cycle.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

Airfoils commonly include internal cooling channels which remove heat from the pressure sidewall and the suction sidewall in order to minimize thermal stresses. Achieving a high cooling efficiency based on the rate of heat transfer is a significant design consideration in order to minimize the volume of coolant air diverted from the compressor for cooling. However, the relatively narrow trailing edge portion of a gas turbine airfoil may include, for example, up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is entailed to provide the requisite rate of heat transfer for maintaining mechanical integrity.

Current methods of manufacturing ceramic cores for investment casting in order to produce these blades and vanes involve the inclusion of master tooling. Specific problems occur with the finishing of the ceramic cores as is practiced in the investment casting industry to produce these turbine blades with internal flow paths. Currently, ceramic core finishing is a cost and labor intensive operation that also drives higher scrap rates due to the fragile mature of high precision ceramic cores. Typically, finishing each ceramic core takes between 1.25 hours to 3 hours. This process also produces the largest generation of scape by rate of any operation in the plant.

SUMMARY

In an aspect of the present invention, a method of manufacturing for finishing of ceramic core flash, the method comprises: locating a first hole on a ceramic core by a laser sensor on a robot; probing for a center of the first hole by a force-torque sensor on the robot; scanning for an axial position of a second hole on the ceramic core; scanning for a third hole on the ceramic core; probing for a center of the third hole; determining axial and radial scale factors based on the first hole location and the third hole location; uploading the axial and radial scale factors to the robot; multiplying the X component position by the axial scale factor and the Z component position by the radial scale factor in an array format; cutting a designated scaled location along the ceramic core to remove flash; and repeating process for additional scaled locations along the ceramic core.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 1:
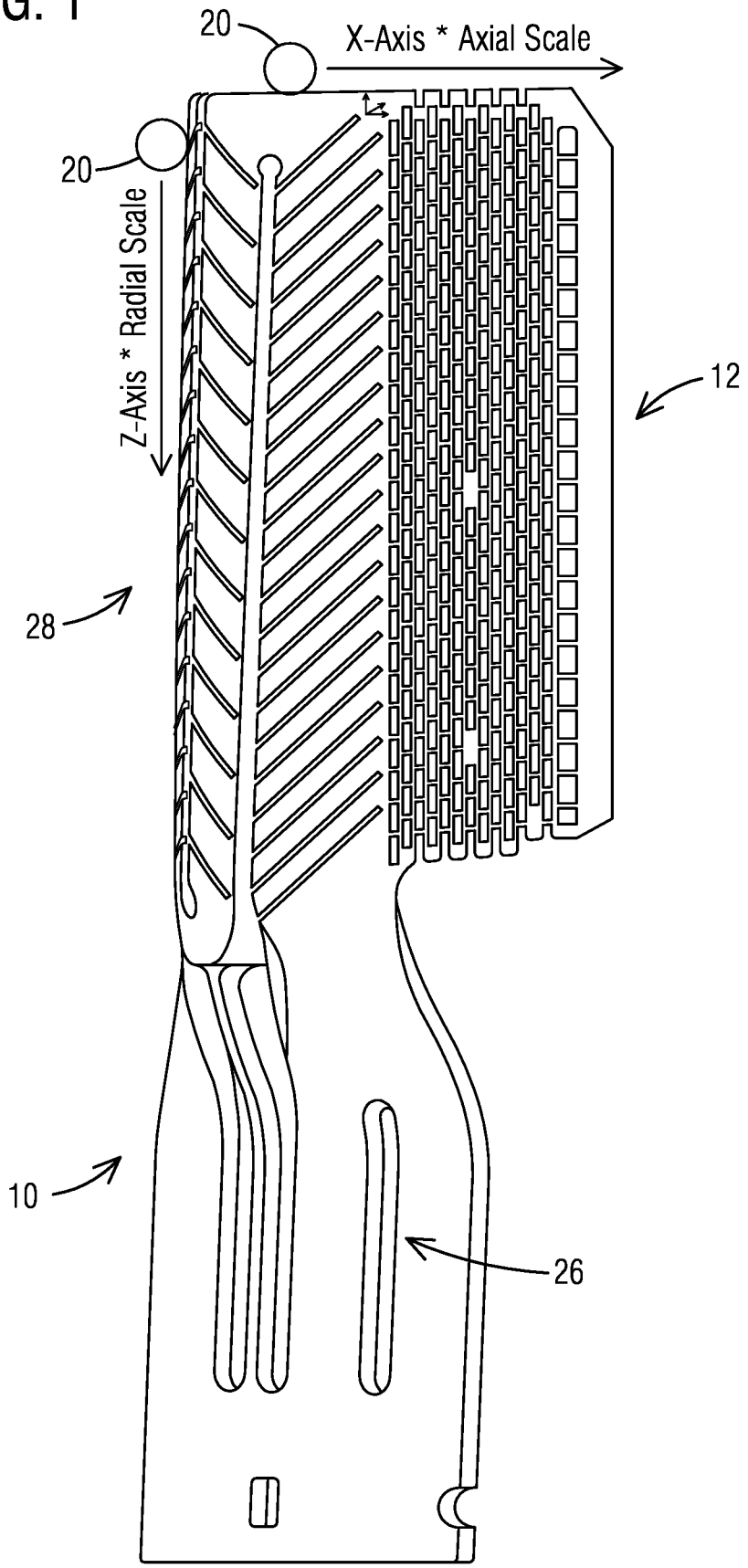
FIG. 1 is a side view of ceramic core for a turbine blade in an exemplary embodiment of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, a method of manufacturing for finishing ceramic core flash. Locating a first hole on a ceramic core by a laser sensor on a robot. Probing for a center of the first hole by a force-torque sensor on the robot. Scanning for an axial position of a second hole on the ceramic core. Scanning for a third hole on the ceramic core. Probing for a center of the third hole. Determining axial and radial scale factors based on the first hole location and the third hole location. Uploading the axial and radial scale factors to the robot Multiplying the X component position by the axial scale factor and the Z component position by the radial scale factor in an array format. Cutting a designated scaled location along the ceramic core to remove flash. Repeating process for additional scaled locations along the ceramic core.

Within the power industry, gas turbine engines are required to provide movement to produce electricity in a generator. In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

Modern engines and certain components such as airfoils, e.g. stationary vanes and rotating blades within the turbine section, implement high pressure ratios and high engine firing temperatures. As advancements are made, components are seeing higher and higher temperatures and require more and more expensive materials to produce these components.

As trailing edges on turbine blades become more advanced and fine feature based, the manufacturing of these airfoils and the costs involved become more important. Components are typically made from ceramic cores. For the purposes of this application, any reference to a ceramic material may also be any other material that functions in a similar fashion. Further, the reference to turbines and the power industry may also be for other processes and products that may require a core made from a casting process. To complete a ceramic core, the core needs to be finished or cleaned of burrs and the like for a smooth finish or surface.

A manufacturing process that allows for rapid low-cost finishing is desirable. Embodiments of the present invention provide a method of manufacturing that may allow for the reduction of cost in manufacturing or finishing the ceramic core as well as the tooling assembly itself. The turbine blade and airfoil are used below as an example of the method and tooling assembly; however, the method and tooling assembly may be used for any component requiring detailed features along a ceramic core for casting purposes. The turbine blade can be within the power generation industry.

The method and tooling assembly mentioned below may be in conjunction with a process that starts with a 3D computer model of a part to be created. From the model a solid surface is created from which a flexible mold can be created that is used in conjunction with a second mating flexible mold to form a mold cavity. The flexible mold is created from a machined master tool representing roughly fifty percent of the surface geometry of the core to be created. From such a tool, a flexible transfer mold can be created. In order to form a mold cavity, a second half of the master tool that creates a second flexible transfer mold, can be combined with the first flexible transfer mold to form the mold cavity. From such a mold cavity a curable slurry can be applied to create a three dimensional component form. An example of such a form can be a ceramic core used for investment casting.

In certain embodiments, such as a ceramic core used for investment casting, materials of construction can be specifically selected to work in cooperation with the casting and firing processes to provide a core that overcomes known problems with prior art cores. The materials and processes of embodiments of the present invention may result in a ceramic body which is suitable for use in a conventional metal alloy casting process.

Computer numerical control (CNC) machining is typical for the finishing of these manufactured cores. The CNC has readily available operations for scaling. Robotic finishing is used in the field, however, have not been used for highly detailed cores such as for turbine blades effectively. One of the main issues is that robotics that are used cannot take into account part to part variation with the core making process with accurate finishing. Robots are not built to create inline adjustments while a part is being built unlike with CNC machines. These part to part variations can be typically found in certain manufacturing processes of cores. Without being able to take into account part to part variation, there is an increase in scraped product with a higher failure rate. With each core manufactured, there is a nominal target. If every core was made exactly to that nominal target then it would not be necessary to scale the machining. Users could run the robot the same path every time. Within the manufacturing process, however, there is variability. If a user were to put core after core on the robot to finish and run the same program, the robot would end up mis-cutting in certain areas creating scrap.

Figure 9:
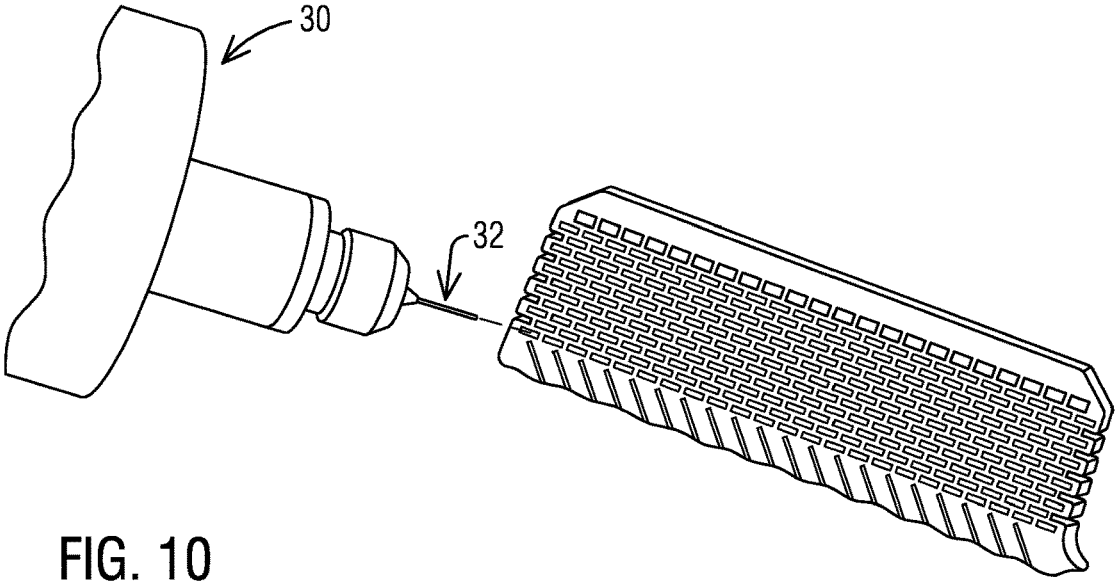
FIG. 9 is a partial perspective view of a robot with force-torque probe of an exemplary embodiment of the present invention.
Figure 10:
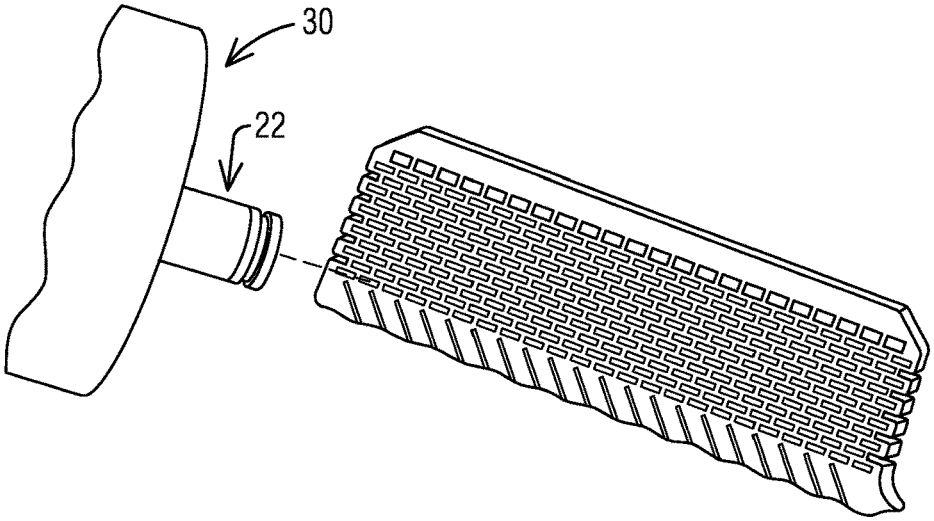
FIG. 10 is a partial perspective view of a robot with laser sensor of an exemplary embodiment of the present invention.

One such robot, Kuka robots as an example, are designed and built to accomplish various tasks, but lack the ability to readily scale pre-determined tool paths. The Kuka robot is equipped with a force-torque sensor 32 and laser sensor 22, as seen in FIG. 9 and FIG. 10 respectively. The robot uses a cartesian coordinate system.

A method used to locate, measure, and scale a tool path for each individual part allows for accurate finishing despite part to part variation within core making process. A macro can further be used to convert a Cartesian file format into an array file format and be converted inline to produce the scaling. In the array format, individual directional components of each position can be manipulated to appropriately scale a tool path and avoid miss cuts of the ceramic core, that creates a scrap core.

The steps of locating, measuring, and scaling a tool path allow the conversion of the robot to function differently than as built. Table 1 shows an example of a conventional input to the robot on the left side. On the right is the same exact coordinate in the line of code. In this sample the macro produces an additional three more lines of code. The second line of code breaks out a Z component of the coordinates and multiplies the Z component by a radial scale determined from an initial laser and force-torque routine. The third line of code breaks out an X component of the coordinates and multiplies the X component by an axial scale determined from the initial laser and force-torque routine. The fourth line of code then directs the robot to move to that linear position.

TABLE 1

| Input Code | Output Code |
|---|---|
| LIN {X #1, Y, #1, Z, #1, A, #1, B, #1, C, #1} C_DIS | myPos[1]={X #1, Y, #1, Z, #1, A, #1, B, #1, C, #1}<br>myPos[1].Z = myPos[1].Z * RadialScale<br>myPos[1].X = myPos[1].X * AxialScale<br>LIN myPos[1] C_DIS |
| LIN {X #2, Y, #2, Z, #2, A, #2, B, #2, C, #2} C_DIS | myPos[1]={X #2, Y, #2, Z, #2, A, #2, B, #2, C, #2}<br>myPos[1].Z = myPos[1].Z * RadialScale<br>myPos[1].X = myPos[1].X * AxialScale<br>LIN myPos[1] C_DIS |

TABLE 1-continued

| Input Code | Output Code |
|---|---|
| LIN {X #3, Y, #3, Z, #3, A, #3, B, #3, C, #3} C_DIS | myPos[1]={X #3, Y, #3, Z, #3, A, #3, B, #3, C, #3}<br>myPos[1].Z = myPos[1].Z * RadialScale<br>myPos[1].X = myPos[1].X * AxialScale<br>LIN myPos[1] C_DIS |

FIG. 1 shows an exemplary embodiment as described below that includes a core fixture, ceramic core 10, that has a home, or origin, position that is a feature nearest to hard locator pins 20 of the core fixture. The origin is placed at the center of the hole nearest to the radial and axial locator pins 20. The home position sets the axes for scaling. An axial scale is produced from an X axis X as shown in FIG. 1. A radial scale is produced from a Z axis Z as shown in FIG. 1. In certain embodiments the ceramic core 10 is a turbine blade having a leading edge 28 and a trailing edge 12. Radially, the core 10 may include root slots 26 along or near one end.

Figure 2:
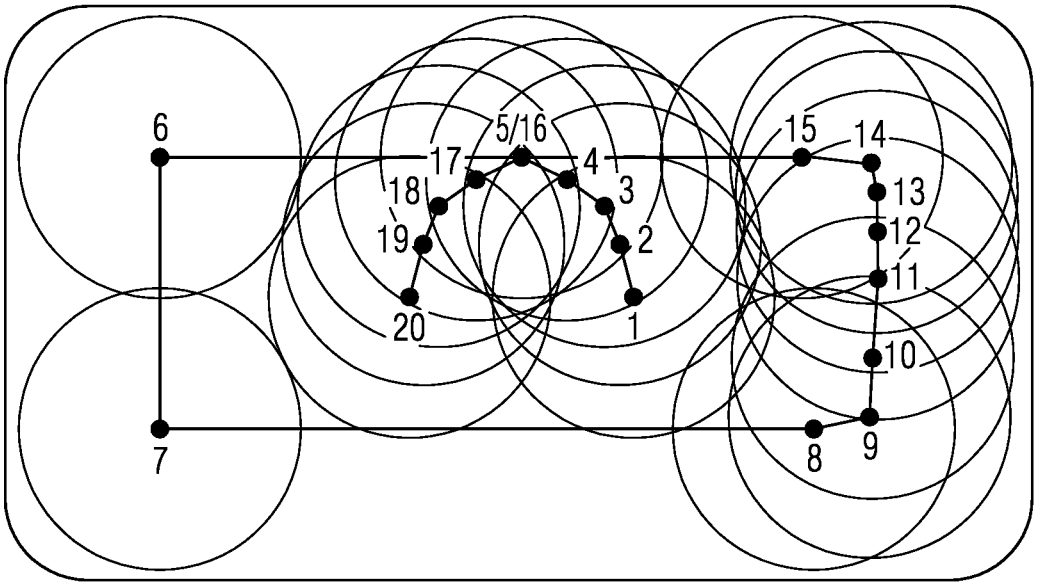
FIG. 2 PRIOR ART
FIG. 2 depicts a pathway for an ATE in the prior art.
Figure 3:
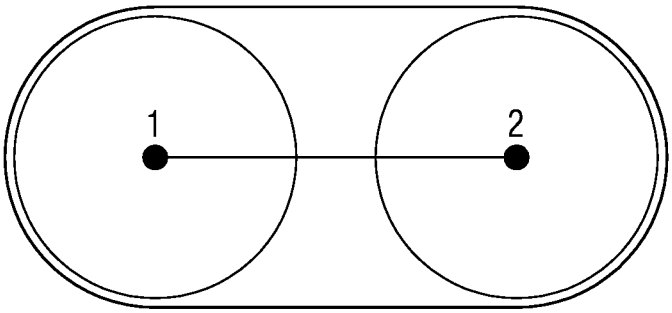
FIG. 3 depicts a pathway for a racetrack shaped in an exemplary embodiment of the present invention.
Figure 4:
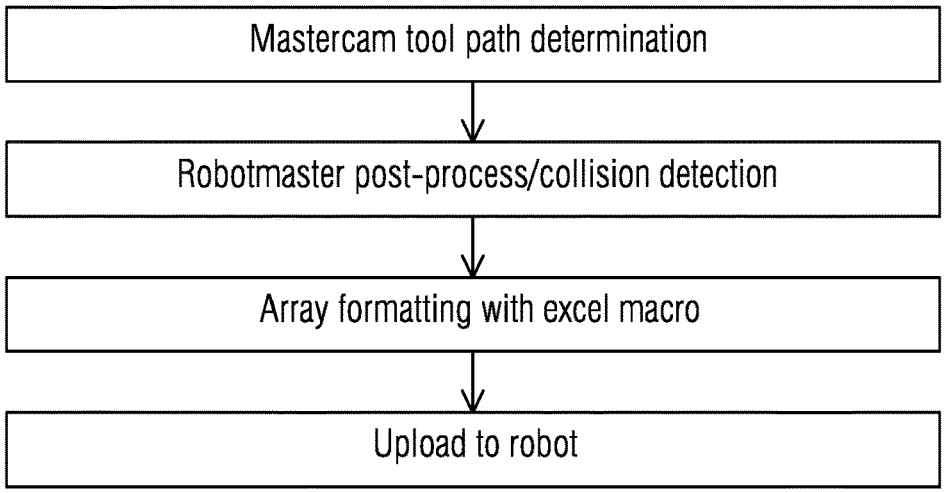
FIG. 4 is a flow chart depicting an exemplary embodiment of a finishing process of an exemplary embodiment of the present invention.
Figure 5:
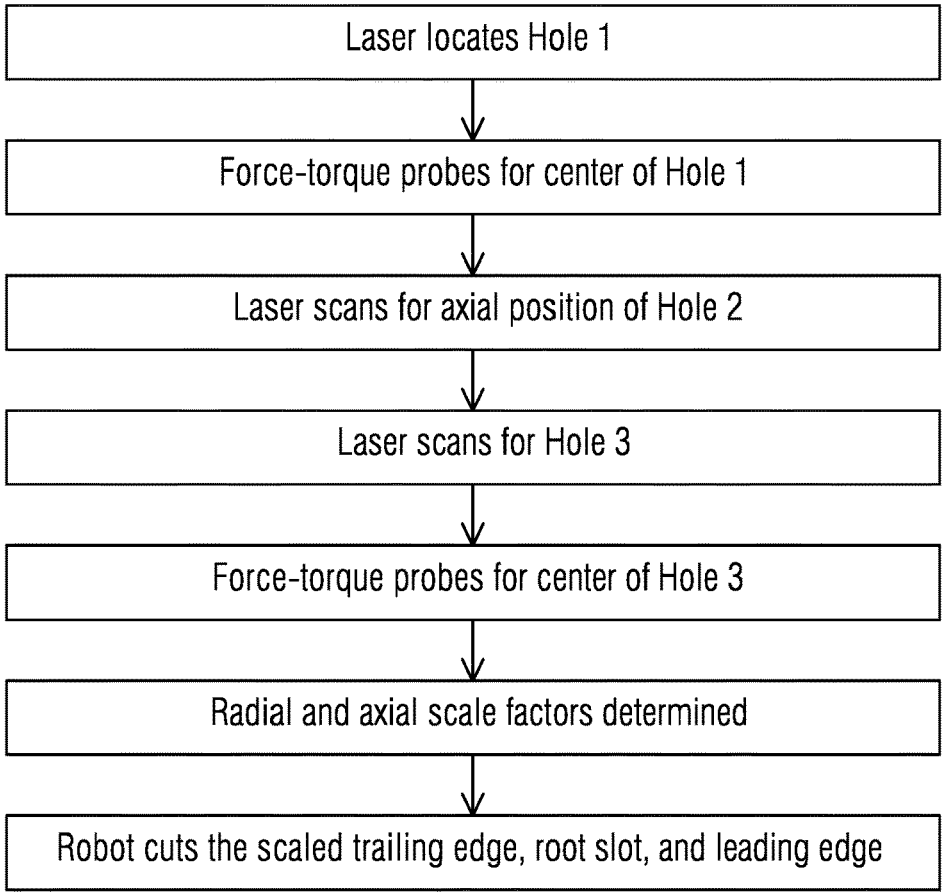
FIG. 5 is a flow chart depicting the steps for finishing an exemplary embodiment of the present invention.
Figure 6:
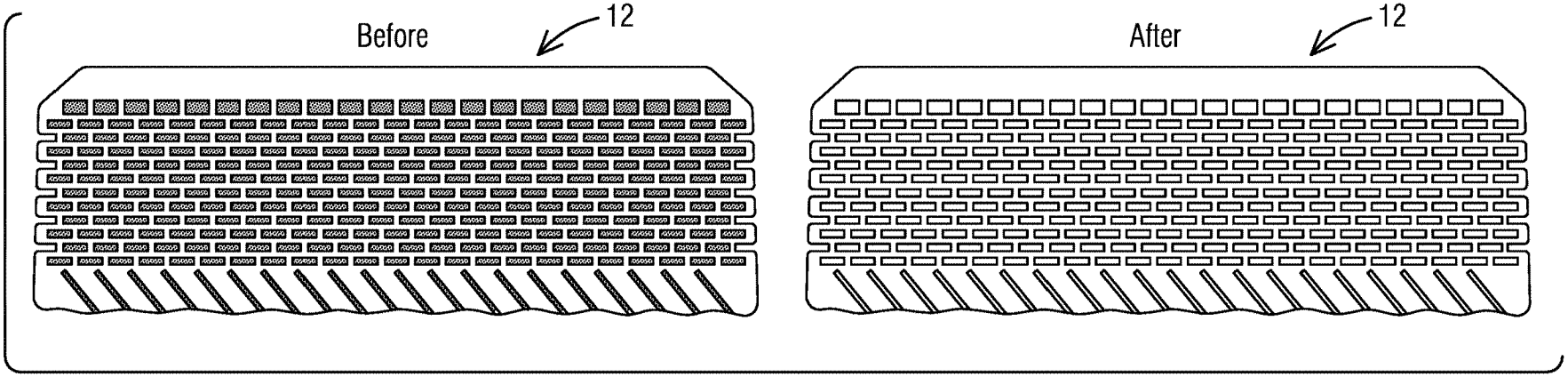
FIG. 6 illustrates finishing results of a trailing edge of a ceramic core using an exemplary embodiment of the present invention.
Figure 7:
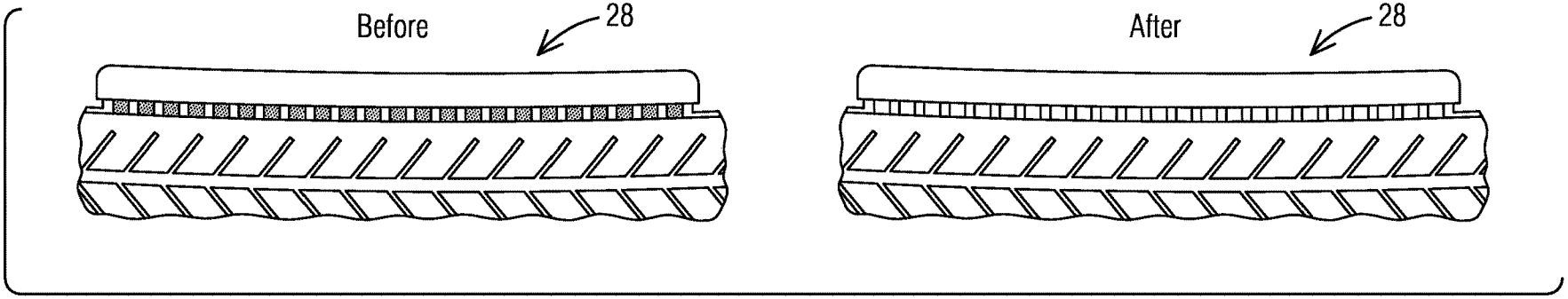
FIG. 7 illustrates finishing results of a leading edge of a ceramic core using an exemplary embodiment of the present invention.
Figure 8:
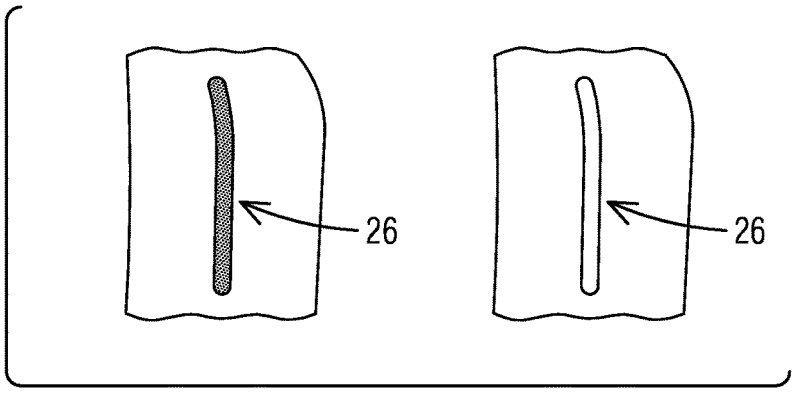
FIG. 8 illustrates finishing results of a root slot of a ceramic core using an exemplary embodiment of the present invention.

Currently, each feature, such as the leading edge 28, trailing edge 12, or root slots 26, takes approximately 20-30 trace points to cut the shape of a core's active trailing edge (ATE) for example with a bit of 0.63 mm diameter. Since the bit is so small, the bit life is limited to 6-8 cores per bit. A sample cycle time for a feature is 76 minutes. Since there are small corner radii, there is no possibility for robotically finishing the core completely. Changing over to a racetrack shape (FIG. 3) opens up the possibility of fully finishing a core's ATE using a robot 30. Each feature takes 2 trace points instead of the 20-30 trace points to cut the racetrack shape. A 1 mm diameter bit can be used extending the bit life. The cycle time for the same feature, using the same parameters as the current shape (shown in FIG. 2), can be reduced to 35 minutes. A predefined code that the robot 30 is using can be changed from a cartesian format to an array format where each component of each position is broken out into individually named coordinates that can be isolated and changed with a scaler factor inline.

Embodiments of the method for finishing of a ceramic core flash includes locating a first hole 14 on a ceramic core 10 by the laser sensor 22 on the robot 30. Once the location of the first hole 14 is found, the robot 30 then probes for a center of the first hole 14 by the force-torque sensor 32 on the robot 30. After probing the center of the first hole 14, the next step is to scan for an axial position of a second hole 16 on the ceramic core 10 by the laser sensor 22. The robot 30 determines the distance between the two holes. Scanning for a third hole 18 along the ceramic core 10 is next. Probing for the center of the third hole 18 through the robot 30. Once the center for the first and third holes are identified, radial and axial scale factors RadialScale,AxialScale need to be determined. The radial and axial scale factors RadialScale,AxialScale are determined. With the cartesian file format, X equals a specific number, and Z equals a specific number. Changing or converting to an array file format allows the position to be identified as a whole line that can be broken out into various components. As an example with an array file format, a user can keep the X and Y components the same, but change the scale factor to Z. The robot 30 then cuts a designated scaled location along the ceramic core 10 to remove flash 24. These steps are repeated for additional scaled location along the ceramic core 10.

The holes are located during this initial laser and force-torque routine. The distance between hole 1 and hole 2 is determined. That distance is then divided by a preset number in the program that comes up with a scale factor in that direction. The scale factor for each component of the coordinate, such as X and Z, can be multiplied. The same is applied with the first hole and the third hole. A separate scale factor is determined and multiplied to the Z component of the array format. As the holes span out from the home or origin, the scale factor becomes of greater significance.

The program takes the individual numbers determined from initial laser and force-torque routine and applies those numbers to the array format that is developed in a variable format, so that the program can remain with each new core. With the new core, locate the initial distance positions and from those new positions develop new scale factors that are applied to that new core. An example of a scale factor to be used can be 1.003. The idea is that the scale factor is likely close to the number 1 and therefore will have a small significance close to the origin, but expand in significance as the holes move away from the origin.

Traditionally, the first pass at flash removal provides only roughly thirty percent of the needed work to complete the finish. Using an embodiment as described above, roughly ninety percent of the work can be completed by the robot 30 alone with minor finishing afterwards for completion.

The process starts with a mastercam toolpath determination. The origin is established, and the location of the holes on the ceramic core 10 are established. Then, there is a robotmaster post-process/collision detection. The force-torque sensor 32 of the robot 30 probe for the center of the holes to determine area to cover. Array formatting of the cartesian format is then processed with a macro that is uploaded to the robot 30. With the updated locations, cutting can be completed by the robot 30 to remove the flash 24 from the core 10. A six-axis robot can be used with scaling for flash removal, instead of a traditional 5-axis milling operation.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A method of manufacturing for finishing of ceramic core flash, the method comprising:

locating a first hole on a ceramic core by a laser sensor on a robot;

probing for a center of the first hole by a force-torque sensor on the robot;

scanning for an axial position of a second hole on the ceramic core;

scanning for a third hole on the ceramic core;

probing for a center of the third hole;

determining an axial and a radial scale factors based on the first hole location and a location of the third hole;

uploading the axial and the radial scale factor to the robot;

multiplying a X component position by the axial scale factor and a Z component position by the radial scale factor in an array format;

cutting a designated scaled location along the ceramic core to remove flash; and repeating process for additional scaled locations along the ceramic core.

2. The method of manufacturing of claim 1, wherein the ceramic core is for a component within the power generation industry.

3. The method of manufacturing of claim 1, wherein the designated scaled location is a trailing edge, root slot, or a leading edge of a ceramic core of a turbine blade.

4. The method of manufacturing of claim 1, wherein the cutting of the designated scaled location along the ceramic core is processed in an oval shape.

* * * * *